US005469829A

United States Patent [19]

Kleppner et al.

[11] Patent Number: 5,469,829

[45] Date of Patent: Nov. 28, 1995

[54] ARRANGEMENT FOR SUPPLYING INTERNAL COMBUSTION ENGINE WITH FUEL FROM SUPPLY CONTAINER

[75] Inventors: Stephan Kleppner, Bretten; Kurt Frank, Schorndorf; Jan Mutschler, Oberstdorf, all of Germany

[73] Assignee: Robert Bosch GmbH, Stuttgart, Germany

[21] Appl. No.: 367,695

[22] Filed: Jan. 3, 1995

[30] Foreign Application Priority Data

Jan. 26, 1994 [DE] Germany ..... 44 02 224.7

[51] Int. Cl.[6] ..... F02M 37/04

[52] U.S. Cl. ..... 123/514; 123/510

[58] Field of Search ..... 123/514, 510, 123/456, 497, 506; 137/110, 563, 576

[56] References Cited

U.S. PATENT DOCUMENTS

| | | | |
|---|---|---|---|
| 4,796,593 | 1/1989 | Woodcock | 123/576 |
| 5,050,567 | 9/1991 | Suzuki | 137/576 |
| 5,070,849 | 12/1991 | Rich | 137/576 |
| 5,148,792 | 9/1992 | Tuckey | 123/497 |
| 5,195,494 | 3/1993 | Tuckey | 123/514 |
| 5,289,810 | 3/1994 | Bauer | 123/514 |
| 5,339,785 | 8/1994 | Wilksch | 123/497 |
| 5,361,742 | 11/1994 | Briggs | 123/514 |

FOREIGN PATENT DOCUMENTS 4231731 8/1993 Germany .

*Primary Examiner*—Carl S. Miller
*Attorney, Agent, or Firm*—Michael J. Striker

[57] ABSTRACT

An arrangement for supplying an internal combustion engine with fuel has a supply container with an opening, a feed pump insertable into the supply container through the opening, a closure part closing the opening and provided with a pressure regulator having a pressure chamber with a connection to a pressure side of the feed pump to an internal combustion engine and to an unloading chamber. The pressure regulator has a spring-loaded closing member controlling the connection with the unloading chamber and cooperating with a seat so that after exceeding of a predetermined pressure in the pressure chamber the connection of the pressure chamber to the unloading chamber is released. The closure part is composed of a synthetic plastic material and having a flange-like base body which closes the opening. The base body is provided with a depression and a pipe which is formed of one piece with the base body and extends into the depression to form the connection of the pressure chamber with the unloading chamber. An elastically deformable diaphragm which covers the depression for forming the pressure chamber and acts as a closing member cooperating with an end of the pipe as the seat. A separate holding element is mounted on the base body so that the diaphragm is clamped between the base body and the holding element.

11 Claims, 3 Drawing Sheets

ARRANGEMENT FOR SUPPLYING INTERNAL COMBUSTION ENGINE WITH FUEL FROM SUPPLY CONTAINER

BACKGROUND OF THE INVENTION

The present invention relates to an arrangement for supplying an internal combustion engine with fuel from a supply container.

One of such arrangements is disclosed for example in the German patent document 42 31 731 A1. This arrangement has a feed pump arranged in a supply container and insertable through an opening in the supply container. The opening in the supply container is closeable by a closure part on which a pressure regulator is arranged. The pressure regulator has a pressure chamber which has a connection to a pressure side of the feed pump, to the internal combustion engine and to an unloading conduit. The connection of the pressure chamber to the unloading conduit is controlled by a spring-loaded closing member which cooperates with a seat and releases the connection to the unloading conduit upon exceeding of a predetermined pressure in the pressure chamber. The closure part has an inner body which is smaller than the opening of the supply container. The inner body is provided with a casing which together with the inner body, sometimes with interposition of a sealing element, closes the opening. Passages are formed in the inner body and provide the connections to the feed pump, to the internal combustion engine and to the unloading conduit. Pipes are inserted as separate parts into the passages which form the connection to the feed pump and to the internal combustion engine, and the conduits for connecting with the feed pump and the internal combustion engine can be fitted on them. The closing member of the pressure regulator is formed as a ball which cooperates with a seat formed in the inner body of the closure part and a cross-section reduction of a passage. For reliable sealing by the ball, the seat must be machined, which means an expensive manufacture of the inner body of the closure part. Moreover, the inner body of the closure part which is provided with the seat must be made of metal for insuring a sufficient service life of the seat. The multi-part construction of the closure part with the inner body and with the casing requires an expensive manufacture. Finally, the pipes must be inserted separately into the inner body. As a whole, the construction of the closure part in this known arrangement is expensive as to its manufacture and mounting, which must be avoided from economical grounds.

SUMMARY OF THE INVENTION

Accordingly, it is an object of the present invention to provide an arrangement for supplying an internal combustion engine with fuel from a supply container, which avoids the disadvantages of the prior art.

In keeping with these objects and with others which will become apparent hereinafter, one feature of the present invention resides, briefly stated, in an arrangement in which the closure part is composed of a synthetic plastic material and has a flange-like base body which closes the opening, the base body is provided with a depression in which a pipe is inserted which forms a connection of the pressure chamber to the unloading chamber and is of one piece with the base body, the depression for forming the pressure chamber is covered with an elastically deformable diaphragm which serves as a closing member and cooperates with an end side of the pipe as a seat, and the diaphragm is clamped between the base body and a separate holding element mounted on the base body.

When the arrangement is designed in accordance with the present invention, it has the advantage that the closure part is formed simply by the one-piece base body which closes the opening. Also, the pressure regulator is formed simply with the diaphragm which operates as the closing member and with the end of the pipe extending in the depression and operating as the seat. A reliable sealing of the not machined seat is also obtained because of the elastic diaphragm.

In accordance with another feature of the present invention, a connecting pipe is formed on the base body of one piece with it, and a conduit for connection with the pressure side of the feed pump and/or the internal combustion engine and/or the unloading chamber is connectable with it. In this construction the one piece formation of the connecting pipe further simplifies the manufacture and mounting of the closure part.

In accordance with another feature of the present invention, the base body on the depression has a recess with a greater cross-section than the depression, and a transition between the depression and the recess is formed as a circumferential collar facing away from the depression. With this construction, a reliable holding of the diaphragm and a simple mounting of all parts of the pressure regulator in one direction is possible.

In accordance with still a further feature of the present invention, the pressure chamber of the pressure regulator is connectable through the pipe with at least one flow pump which supplies the fuel flowing through the pressure regulator into a reservoir from which the feed pump sucks the fuel. Here the fuel which is discharged from the pressure regulator can be used for operation of the flow pump which is especially advantageous for supply containers having cavities in order to guarantee that sufficient fuel is available in the reservoir from which the feed pump aspirates the fuel.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
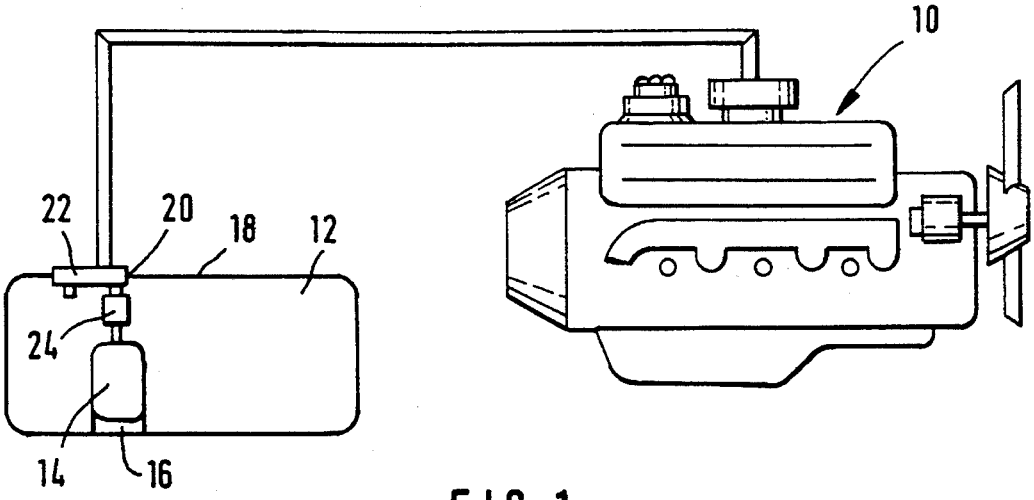
FIG. 1 is a view showing an arrangement for supplying an internal combustion engine with fuel from a supply container.

An arrangement schematically shown in FIG. 1 operates for supplying an internal combustion engine 10 with fuel from a supply container 12. The arrangement has a feed pump 14 located in the supply container 12 and mounted there in a not shown manner. The feed pump 14 can have any constructions and sucks fuel at its suction side from a reservoir 16 in the supply container 12. The supply container 12 has a wall 18 with an opening 20 through which the feed pump 14 can be inserted. The opening 20 after insertion of the feed pump 14 is closeable with a closure part 22. The closure part provides a conduit for connection of the pressure side of the feed pump 14 with the internal combustion engine 10. A fuel filter 24 can be arranged in the connection of the pressure side of the feed pump 14 with the closure part 22.

Figure 2:
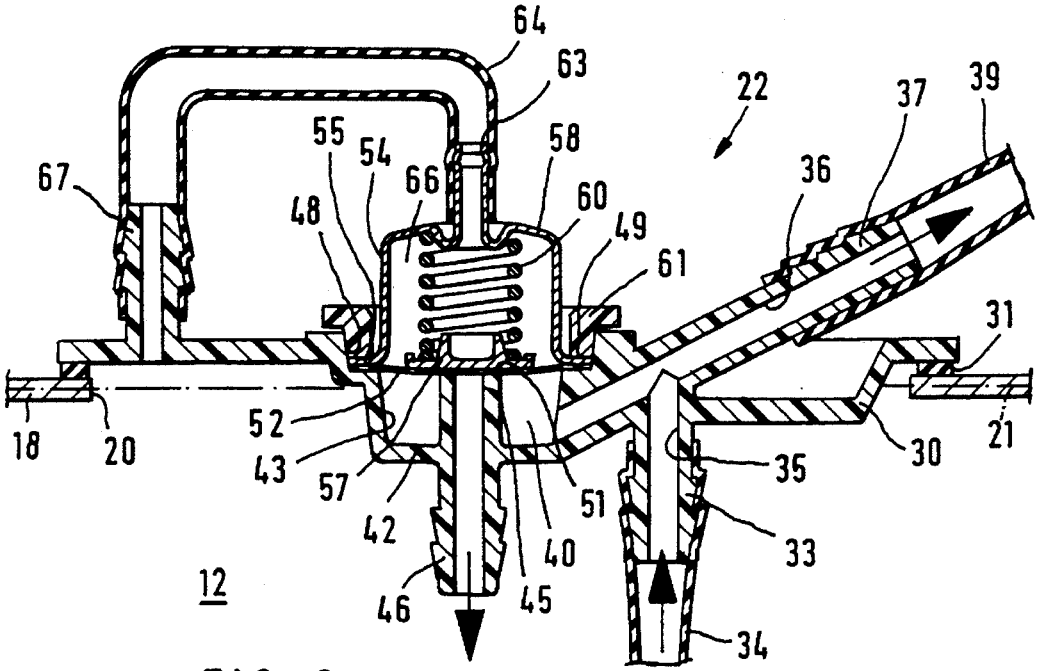
FIG. 2 is a view showing a closure part of the supply container of FIG. 1 in a longitudinal section and on an enlarged scale, in accordance with a first embodiment.

FIG. 2 shows a first embodiment of the closure part 22. The closure part has a flange-like base body 30 which can be produced by injection molding of synthetic plastic material. It covers the opening 20 of the supply container 12. A ceiling element 31 can be arranged between the outer edge of the closure part 22 and the wall 18 of the supply container 12. The closure part 22 is mounted on the supply container 12 in a not shown manner. Subsequently on the closure part 22 position determination is provided in accordance with which an arrangement inwardly is identified in the interior of the supply container 12 and an arrangement outwardly is identified as facing away from the supply container 12. A connecting pipe 33, an inwardly extending connecting pipe 23 is formed of one piece with the base body 30 and is connectable with a conduit 34 for connection with the pressure side of the feed pump 14. A further connecting pipe 37 extends outwardly from the base body 30 and is connectable with a conduit 39 for connection with the internal combustion engine 10. The connecting pipes 33 and 37 are connected with one another by passages 35 and 36 formed in the base body 30.

The passage 35 of the connecting pipe 33 extends substantially perpendicularly to a plane 21 in which the opening 20 is arranged, while the passage 36 of the connecting pipe 37 is inclined away from the plane 21. The passage 36 opens into a depression 40 which is formed substantially centrally in the base body 30. The depression 40 is limited inwardly by a bottom 42 of the base body 30 and limited laterally by a circumferential edge 43 which is open outwardly. The passage 36 opens a gauge 43 over the bottom 42 in the depression 40. The depression 40 can be formed round or cornered in a cross-section parallel to the plane 21 in which the opening 20 extends. A pipe 45 extends from the bottom 42 of the base body 30 into the depression 40 or in other words outwardly on the base body 30, substantially centrally. A connecting pipe 46 extends substantially coaxially to the pipe 45 inwardly from the bottom 42 and can be connected with a conduit.

A recess 48 is formed at the base body 30 outwardly of the depression 40 and connected with the latter. It has a greater cross-section than the depression 40. A circumferential, flat outwardly extending collar is formed at the transition between the depression 40 and the recess 48. An end 51 of the pipe 45 extends in the depression 40. It is arranged at the same height as the collar 49 and is substantially flat. An elastically deformable diaphragm 52 is inserted from outside in the recess 48. It abuts with its outer edge against the collar 49 and with its central region against the end 51 of the pipe 45. A cup-shaped holding element 54 is arranged in the recess 48 over the diaphragm 52. It is inserted with its open end in the recess 48 and has there a flange 55 arranged so that the outer edge of the diaphragm 52 is sealingly clamped between the flange and the collar 49. A spring plate 57 abuts on the outwardly extending side of the diaphragm 52 in its central region, and a pressure spring 60 is clamped between the spring plate and a bottom 58 of the holding element 54. The holding element 54 can be formed for example as a sheet metal part.

A ring 61 composed of synthetic plastic material is inserted over the holding element 54 as a mounting element. It is inserted in the recess 48. The outwardly extending side of the flange 55 engages on it and is mounted on the base body 30. The holding element 54 is fixed on the base body 30 by the ring 61. The ring 61 can be mounted on the base body 30 for example by welding, such as ultrasound or friction welding or glued, or connected with the base body 30 in another manner. A connecting pipe 33 extends outwardly from the bottom 58 of the holding element 54. A conduit 64, for example a hose is connectable with its end for communicating a chamber 66 limited by the holding element 54 and the diaphragm 52 and containing the pressure spring 60 with the atmosphere. The base body 30 has a further outwardly projecting connecting pipe 67 which is open outwardly and is connected with another end of the conduit 64. The chamber 66 is thereby connected with the interior of the supply container 12 in which the atmospheric pressure acts. It is therefore guaranteed that no foreign bodies can penetrate into the chamber 66, such as for example dirt or water. Moreover, it is thereby also guaranteed that the fuel vapors which diffuse into the chamber 36 through the diaphragm 52 cannot escape to the surrounding area but are again supplied into the supply container 12.

The depression 40 forms together with the diaphragm 52 a closed pressure chamber which is connected through a passage 36 with the pressure side of the feed pump 14 and with the internal combustion engine 10. The pressure chamber is also connectable through the pipe 45 with an unloading chamber which in this embodiment is the supply container 12 in which the connecting pipe 46 opens. By the pretensioning of the pressure spring 30, the diaphragm 52 is pressed against the end 51 of the pipe 45 and closes the pipe as long as the pressure acting in the pressure chamber applies a smaller force to the diaphragm 52 than the pressure spring 60. When the pressure in the pressure chamber exceeds a predetermined value determined by the pretensioning of the pressure spring 30, the diaphragm 52 is lifted from the end 51 and releases the pipe 45, so that fuel can flow back from the pressure chamber into the supply container 12 which operates as the unloading chamber.

The above described construction represents a pressure regulator which is arranged on the closure part 22, and the diaphragm 52 serves as a closing member which cooperates with the end 51 of the pipe 45 as a seat. The construction of the closure part 22 and the pressure regulator is therefore very simple, and the mounting of the components of the pressure regulator is possible in one direction from outside. The arrangement needs only one conduit for connection with the internal combustion engine 10, while a return flow conduit is not needed since the excessive fuel can discharge in the pressure regulator into the unloading chamber.

Figure 3:
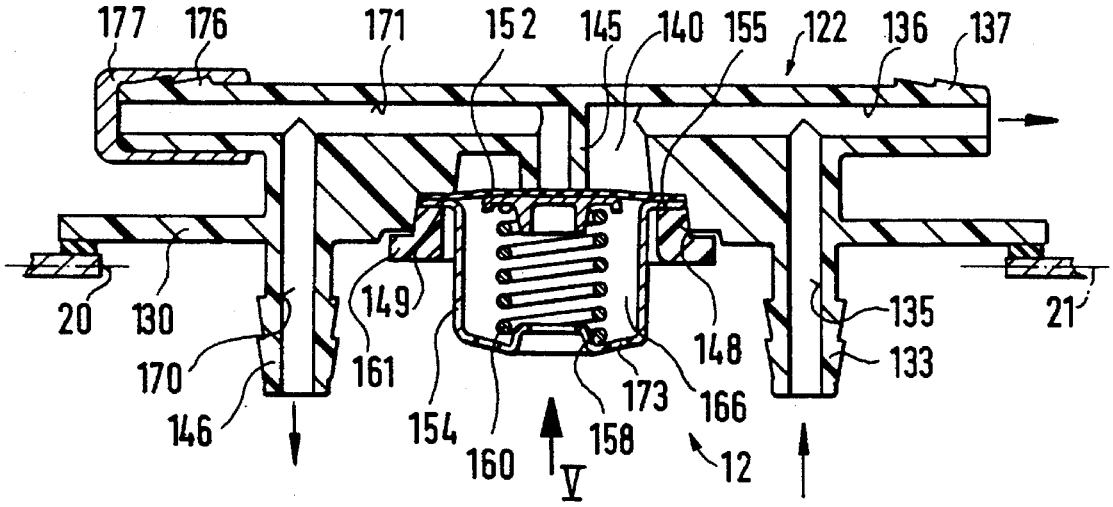
FIG. 3 is a view showing a second embodiment of the closure part of the inventive arrangement.

FIG. 3 shows a second embodiment of the closure part 122 in which similar parts are identified with the same reference numerals increased by 100. The closure part 122 has a base body 130 produced by injection molding from synthetic plastic material and closing the opening 20. The connecting pipe 133 extends inwardly from the base body 130 for connection with the pressure side of the feed pump 14, and the connection pipe 137 extends outwardly for connection with the internal combustion engine 10. Both connecting pipes 133 and 137 communicate with one another through the passages 135 and 136 formed in the base body 130. The passage 135 of the connecting pipe 133 extends substantially perpendicularly to the plane 21 in which the opening 20 is arranged while the passage 136 of the connecting pipe 137 extends substantially parallel to the plane 21 outside the supply container 12. Moreover, a connecting pipe 146 extends inwardly of the base body 130. It is connected with a pipe 145 extending inwardly into the depression 140 through a passage 170 which extends substantially perpendicular to the plane 21 and arranged in the opening 20 and through a further passage 171 extending substantially parallel to this plane. The depression 140 is arranged in reverse position with respect to the first embodiment, so that it is open inwardly or in other words into the supply container 12.

The recess 148 is formed in the base body 30 inwardly of the latter and is connected with the depression as in the first embodiment. The diaphragm 152 abuts with its outer edge on the inwardly extending collar 149 and is fixed with the holding element 154 which is mounted by the ring 161 on the base body 130. The holding element 154 is cup-shaped as in the first embodiment and arranged with its flange 155 in the recess 148. The outer edge of the diaphragm 152 is clamped between the flange and the collar 149. The pretensioned pressure spring 160 is arranged between the bottom 158 of the holding element 154 and the central region of the diaphragm 152. At least one opening 173 is formed in the bottom 158 and communicates the chamber 166 limited in the holding element 154 with the interior of the supply container 12. In this embodiment there is no separate conduit for connecting the chamber 166 with the supply container 20. The passage 136 can open in a connecting pipe 176 arranged outside of the supply container 12 and closeable by a cover 177. Therefore a discharge of fuel from the pressure chamber through the connecting pipe 146 into the supply container 12 is performed. Alternatively, a conduit can be fitted on the connecting pipe 176 so that the fuel discharged from the pressure chamber can be used for other purposes, and the connecting pipe 146 is closed by a cover.

Figure 4:
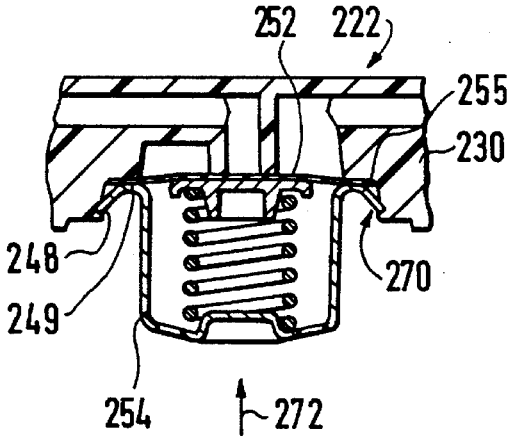
FIG. 4 is a view showing a first variant of mounting of a holding element of a closure part of FIG. 3.

FIG. 4 shows a variant of the closure part 222 with a modified mounting of the holding element 254. Here the holding element 254 is mounted directly on the base body 230 in the recess 284 and the ring 61 or 161 is not required. The base body 230 substantially corresponds to the second embodiment. The holding element 254 is formed substantially as in the first and second embodiments and has a sheet metal part and has a flange 255 for clamping the outer edge of the diaphragm 252 between the flange and the collar 249. At least one hook is formed from the region of the holding element 254 in which the recess 248 is arranged. In the not inserted condition of the holding element 254 the hook 270 laterally projects outwardly beyond the recess 248 and is turnable transversely to the insertion direction of the holding element 254 in accordance with the arrow 272 in a springy fashion inwardly. The free end of the hook 270 extends outwardly or in other words opposite to the insertion direction 272.

During insertion of the holding element 254 in the recess 248 the hook 270 swings springily inwardly and enters the recess 248. The holding element 254 is pressed into the recess 248 so that the diaphragm 252 is clamped. The end of the hook 270 engages on the edge of the recess 248 so that the holding element 254 is fixed. When a force acts on the holding element 254 against the insertion direction 272, the end of the hook 270 engages as a bar in the recess 248. Since the holding element 254 is composed of a sheet metal and the base body 230 is composed of synthetic plastic material, the end of the hook 270 penetrates in the edge of the recess 254 under plastic deformation of the base body 230. Preferably, several hooks 270 are distributed over the periphery of the holding element 254.

Figure 5:
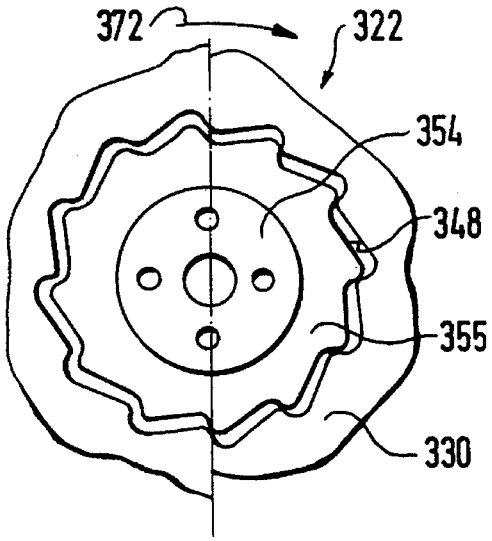
FIG. 5 is a view showing a second variant of the mounting of the holding element in direction of the arrow V in FIG. 3.

FIG. 5 shows a second variant of the closure part 322 with a further modified mounting of the holding element 354. The holding element 354 is here mounted directly on the base body 330, which is substantially described in the second embodiment. The holding element 354 similarly to the first and the second embodiments is formed as a sheet metal part. It has a flange 355 arranged in the recess 348 for clamping the outer edge of the diaphragm between the flange and the collar. The outer edge of the flange 355 and the recess 348 is substantially circular. The outer edge of the flange 355 has a saw-tooth shaped periphery, while the inner edge of the recess 348 is provided on its periphery with a corresponding saw-tooth shaped counter profile. The holding element 354 is insertable in the recess 348 in the rotary position shown in the left half of FIG. 1. The saw teeth of its flange 355 extend in the corresponding gaps at the inner edge of the recess 348. The holding element 355 is pressed in the recess 348 and therefore the diaphragm 352 is reliably clamped and simultaneously turned in direction of the arrow 372, so that the saw teeth of the flange 355 engage with saw teeth of the inner edge of the recess 348 as shown in the right half of FIG. 3. Therefore the saw teeth of the flange 355 penetrate in the inner edge of the recess 348 under plastic deformation, and the holding element 354 is mounted on the base body 330.

Figure 6:
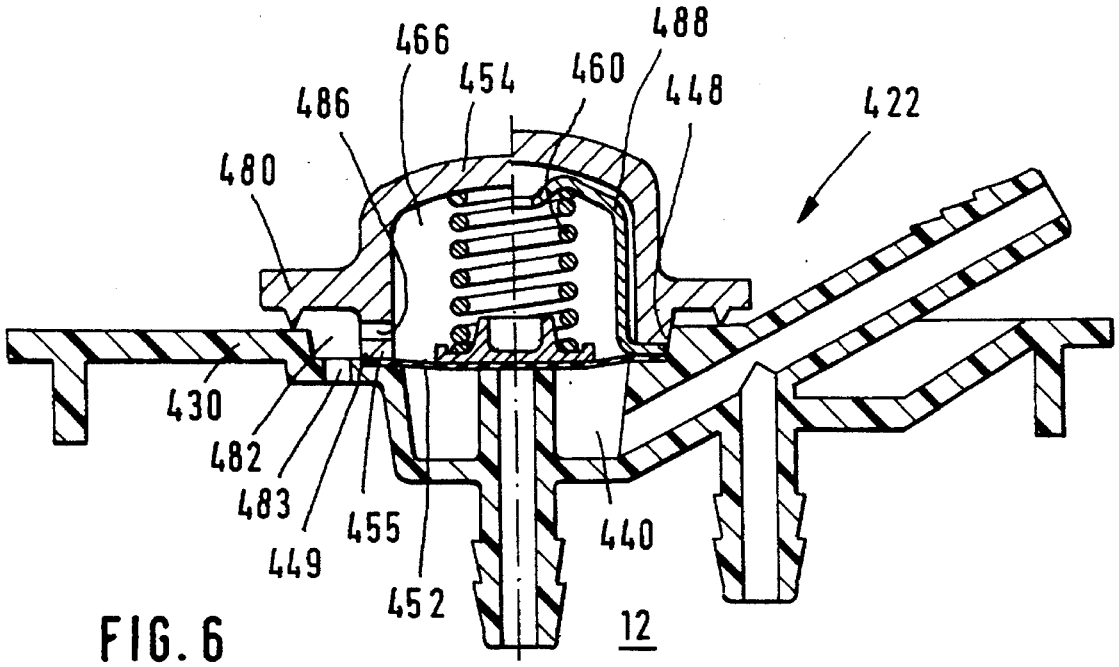
FIG. 6 is a view showing a third embodiment of the closure part of the inventive arrangement.

A variant of the closure part 422 with a modified holding element 454 is shown in FIG. 6 in the left half. The base body 430 of the closure part 422 and the holding element are substantially formed as in the first embodiment of FIG. 2. The holding element 454 is composed of synthetic plastic material, it is cup-shaped and extends with its open end toward the base body 430. The holding element 454 has the flange 455 with which it is in the recess 448, and the outer edge of the diaphragm 452 is clamped between the flange and the collar 449. The holding element 454 also has a collar 480 which laterally circumferentially extends from the recess 448. The recess 448 is provided at least at a location of its periphery with a depression 482 which is connected through an opening 483 in the base body 430 with the interior of the supply container 12. An opening 486 is provided in the holding element 454 and communicates the chamber 466 of the holding element 455 located opposite to the depression 440 on the diaphragm 452 with the depression 482. The pressure spring 460 is arranged in the chamber 466. The depression 482 as well as the collar 480 which overlaps the depression and the flange 455 of the holding element 454 limit a chamber through which the chamber 466 is connected with the atmosphere or in other words with the interior of the supply container 12. In the above described construction as shown in the right half of FIG. 6, a support part 488 composed of a sheet metal is arranged inside the holding element 454 for the pressure spring 460. It has a flange arranged in the recess 448, so that the outer edge of the diaphragm 452 is clamped between the flange and the collar 449. The holding element 454 presses with its flange 455 against the flange of the support part 488 and holds the latter. When the support part is also cup-shaped, it has an opening for connection of the chamber 466 formed in the support part 488, with the depression 482 of the recess 448.

Figure 7:
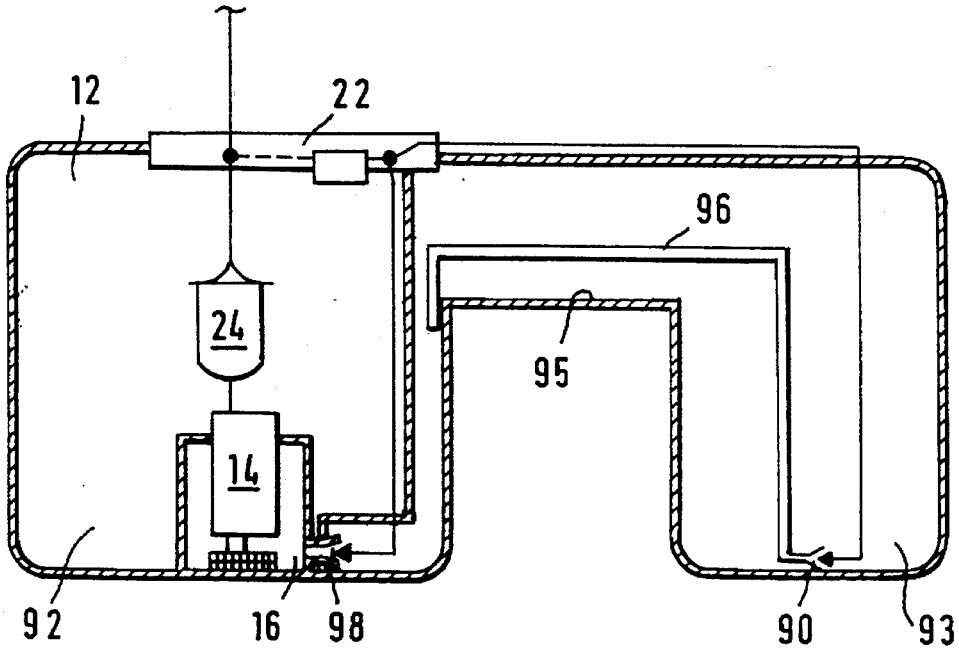
FIG. 7 is a view showing a supply container of the arrangement with an additional flow pump.

FIG. 7 shows a modified embodiment of the whole arrangement which substantially corresponds to the above described arrangements. The connecting pipe 46 or 146 of the base body which connects the pressure chamber with an unloading chamber is connected with at least one flow pump 90 which supplies the fuel into the reservoir 16 from which the feed pump 14 aspirates the fuel. This is especially advantageous for supply containers 12 having cavities, which are provided with several parts 92, 93 with bottoms separated from one another by raised humps or saddles 95, so that the fuel cannot flow between the parts 92, 93. The flow pump 90 is arranged in the part 93 which is separated from the part 92 in which the feed pump 14 is arranged. The flow pump 90 supplies fuel over the hump 95 through a conduit 96 into the part 92. Moreover, a flow pump 98 is arranged in the pump 92 for supplying the fuel into a cup which serves as a reservoir 16 for the feed pump 14.

It will be understood that each of the elements described above, or two or more together, may also find a useful application in other types of constructions differing from the types described above.

While the invention has been illustrated and described as embodied in an arrangement for supplying internal combustion engine with fuel from supply container, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for supplying an internal combustion engine with fuel, comprising a supply container with an opening; a feed pump insertable into said supply container through said opening; a closure part closing said opening and provided with a pressure regulator having a pressure chamber with a connection to a pressure side of said feed pump to an internal combustion engine and to an unloading chamber, said pressure regulator having a spring-loaded closing member controlling the connection with the unloading chamber and cooperating with a seat so that after exceeding of a predetermined pressure in said pressure chamber the connection of said pressure chamber to said unloading chamber is released, said closure part being composed of a synthetic plastic material and having a flange-like base body which closes said opening, said base body being provided with a depression and a pipe which is formed of one piece with said base body and extends into said depression to form the connection of said pressure chamber with said unloading chamber; an elastically deformable diaphragm which covers said depression for forming said pressure chamber and acts as a closing member cooperating with an end of said pipe as the seat; and a separate holding element mounted on said base body so that said diaphragm is clamped between said base body and said holding element.

2. An arrangement as defined in claim 1; and further comprising at least one connecting pipe which is formed of one piece on said base body and connectable with a conduit for connection with at least one of the pressure side of said feed pump, the internal combustion engine and the unloading chamber.

3. An arrangement as defined in claim 1; and further comprising a closure spring clamped between said holding element and said diaphragm for pressing said diaphragm against said end of said pipe.

4. An arrangement as defined in claim 1, wherein said holding element is cup-shaped and is provided with a flange at its end which opens toward said base body, said diaphragm having an edge clamped between said flange and said base body.

5. An arrangement as defined in claim 1, wherein said base body has a recess adjoining said depression and having a greater cross-section than said depression, said base body being also provided with a circumferential collar which is arranged at a transition between said depression and said recess and faces away from said depression.

6. An arrangement as defined in claim 5, wherein said diaphragm has an edge abutting against said collar, said holding element having a flange inserted in said recess.

7. An arrangement as defined in claim 5, wherein said holding element is formed as a sheet metal part and has a region arranged in said recess and provided with at least one hook which is elastically turnable transversely to an insertion direction of said holding element, said hook engaging an edge of said recess and thereby fixing said holding element on said base body.

8. An arrangement as defined in claim 5, wherein said holding element is formed as a sheet metal part and has a flange with a saw-tooth-shaped periphery, while said recess has an edge which is provided with a corresponding saw-tooth-shaped counterprofile, said holding element being insertable into said recess in a rotary position and by rotating of said holding element said flange engages in said edge of said recess transversely to an insertion direction of said holding element under plastic deformation and thereby fixes said holding element on said base body.

9. An arrangement as defined in claim 1; and further comprising a separate mounting element which mounts said holding element on said base body.

10. An arrangement as defined in claim 5, wherein said holding element and said base body limit a chamber which is connected through an opening in said base body with said supply container, said diaphragm having a chamber which is opposite to said depression and is connected with said chamber limited between said holding element and said base body.

11. An arrangement as defined in claim 1; and further comprising a reservoir from which said feed pump aspirates fuel; at least one jet pump which supplies fuel discharged through said pressure regulator into said reservoir; and a pipe which connects said pressure chamber of said pressure regulator with said at least one jet pump.

* * * * *